US006165047A

United States Patent [19]

Scott et al.

[11] Patent Number: 6,165,047

[45] Date of Patent: Dec. 26, 2000

[54] TWO-IN-ONE BRASSIERE FOR BREAST ENHANCEMENT AND SUPPORT

[76] Inventors: Hester B. Scott; Andrea N. Scott, both of 102 Sugar Cane Ct., Greer, S.C. 29650

[21] Appl. No.: 09/384,955

[22] Filed: Aug. 27, 1999

[51] Int. Cl.[7] ..... A41C 3/00

[52] U.S. Cl. ..... 450/55; 450/1

[58] Field of Search ..... 450/1, 7, 8, 10, 450/12, 15, 16, 31, 32, 41, 47, 48, 49, 51, 52, 54, 55, 57

[56] References Cited

U.S. PATENT DOCUMENTS

| | | | |
|---|---|---|---|
| 2,621,328 | 12/1952 | Duchnofskey . | |
| 2,863,460 | 12/1958 | Monroe . | |
| 2,897,821 | 8/1959 | Lerner . | |
| 5,098,330 | 3/1992 | Greenberg . | |
| 5,873,767 | 2/1999 | Pickett | 450/1 |

*Primary Examiner*—Gloria M. Hale
*Attorney, Agent, or Firm*—Cort Flint

[57] ABSTRACT

A breast enhancing brassiere is disclosed comprising a pair of laterally spaced breast cups joined together by a center section. At least one shoulder strap is connected to each breast cup. Inner cups for receiving the breasts included in each breast cup having an integral layer of padding. Outer cups are carried adjacent the inner cups having an integral layer of padding. A curved reinforcing element carried along lower and edges of the breast cup lifting the inner and outer cups when the brassiere is worn and the shoulder straps are in a properly adjusted position. Means are providing for securing the inner and outer cups together at selected areas. Upper free edges of the inner and outer edges are unattached to permit relative movements of the free edges during adjustment of the shoulder straps so that the inner cups remain firmly against the breast to enhance breast cleavage appearance while the outer cups provide a fuller breast appearance.

24 Claims, 5 Drawing Sheets

TWO-IN-ONE BRASSIERE FOR BREAST ENHANCEMENT AND SUPPORT

BACKGROUND OF THE INVENTION

The invention relates to an undergarment for women, and more particularly to a brassiere which incorporates two breast cups in one for enhanced breast support and appearance in a natural manner.

Previously, breast enhancement brassieres have been provided such as shown in U.S. Pat. Nos. 5,098,330; 2,897,821; 2,863,460; and 2,621,328. Other constructions for a brassiere having padded breast cups for breast enhancement are also known in the art. For example, one popular brassiere incorporates breast pads in the bottom of the breast cups which form a shelf support that lifts the breast upwardly to enhance cleavage. In particular, these brassieres are worn by women having small breasts who wish to enhance their appearance without resorting to surgical techniques, such as breast implants. In effect, the lower shelf padding fills the breast cup forcing the breast up and outward to enhance appearance. The padding of such brassieres may be a polyester used to make a fiberfill or a foam insert.

The above mentioned U.S. Pat. No. 5,098,330 seeks to improve on the known breast enhancement brassieres, namely the shortcomings of foam insert and fiberfill materials, to provide a long lasting structure which enhances breast cleavage. The invention proposes using a combination of foam and polyfill padding between three layers in each breast cup. As with previous breast enhancing brassieres, the breast cups incorporating the different padding and inserts are constructed as one piece. Thus the breast enhancing capabilities of the brassieres are limited. In addition, the one piece constructions often result in the breast cups moving away from the body and breast during certain body movements. In the case of a small breasted woman wearing the brassiere for enhancement, this often results in the breast being exposed resulting in embarrassment. For example, when leaning forward, particularly when wearing low cut apparel, it is likely that the breast cups will move away from the body revealing that the woman is wearing a breast enhancing brassiere. In addition, the previous brassieres having been mainly for small breasted women and have done nothing to enhance the support and appearance of large breasted women.

Accordingly, an object of the present invention is to provide a breast enhancement and support brassiere which provides a natural appearance.

Another object of the present invention is to provide a breast enhancement and support brassiere which may be adjusted in a variety of breast enhancement and support configurations.

Another object of the present invention is to provide a breast enhancing and support brassiere having a pair of breast cups wherein each breast cup includes an inner and outer cup for independent support wherein the inner cup may be adjusted to remain firmly against the breast curing body movement such as leaning forward.

Still another object of the invention is to provide a breast enhancing and support brassiere wherein each breast cup includes separate inner and outer cups which may be adjusted individually for a desired enhancement of breast cleavage and fullness.

SUMMARY OF THE INVENTION

The above objectives are accomplished according to the present invention by a breast enhancing brassiere comprising of a pair of laterally spaced breast cups joined together by a center section on the front of the brassiere and a back strap on the back of the brassiere. At least one shoulder strap is connected to each breast cup and each breast cup includes a self-contained inner and outer cup. Padding is carried within the inner and outer cups and the outer cup substantially encloses the inner cup. Attached edges of the inner and outer cups are secured together along the lower and side edges of the breast cups; with a curved reinforcing element along the attached edges of the breast cup lifting the breast cups when the brassiere is worn and the shoulder straps are properly adjusted. Advantageously the inner and outer cups are separable along unattached upper free edges of the inner and outer cups so that the upper free edges may move relative to one another for independent adjustment. In this manner the inner cup may be firmly held against the breast in a properly adjusted position regardless of movement of the outer cup to maintain breast coverage during body movements such as leaning forward when wearing low-cut apparel to provide a natural enhanced cleavage and breast appearance.

Preferably, the curved reinforcing element includes a first underwire associated with the inner cup, and a second underwire associated with the outer cup wherein the second underwire is disposed substantially below the first underwire so that the second underwire exerts an increased lifting force on the first underwire and inner cup. Since the inner and outer cups are substantially unattached along the upper free edges from at least one shoulder strap to the center section of each breast cup, independent adjustment and movement may be had yet the two cups appear integral as one.

Preferably a cup strap is separately attached to the inner and outer cups of each breast cup, and each cup strap includes a strap adjustment so that the lift of the inner and outer cups may be adjusted individually. The upper free edges allow relative movements between the cups during adjustment of the cup straps. Other strap and adjustment arrangements may be used, it being mainly important that means be provided to individually adjust the self-contained inner and outer cups.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF THE PREFERRED EMBODIMENT

Figure 1:
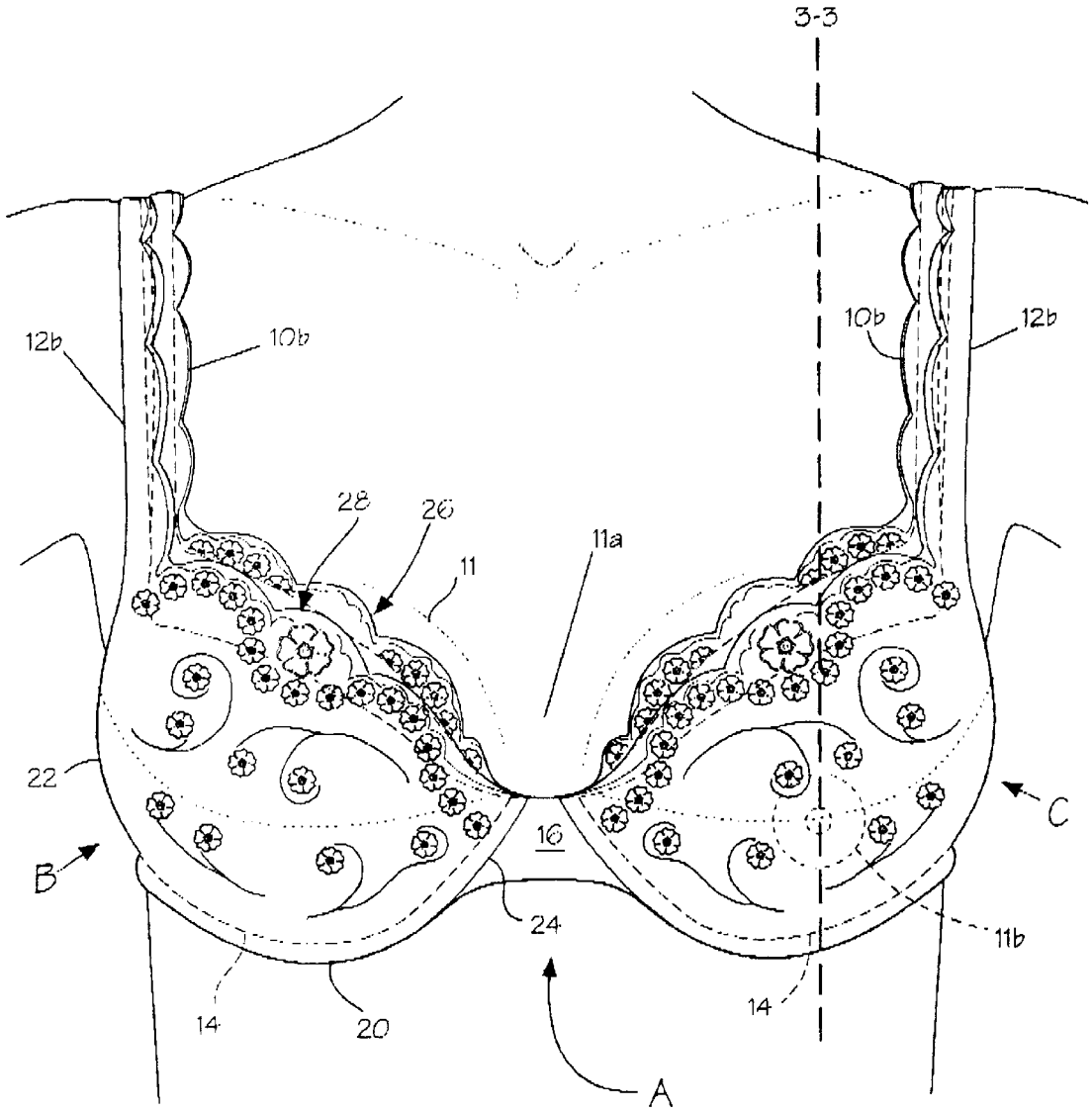
FIG. 1 is a front elevation illustrating a breast enhancement and support brassiere constructed according to the present invention.

Referring now to the drawings, the invention will now be described in more detail.

A breast enhancement and support brassiere, designated generally as A, is illustrated as including a pair of laterally spaced breast cups, designated generally as B and C. The breast cups are joined by a center section 16 and a back strap 16*a* (FIG. 5) in a conventional manner.

Figure 2:
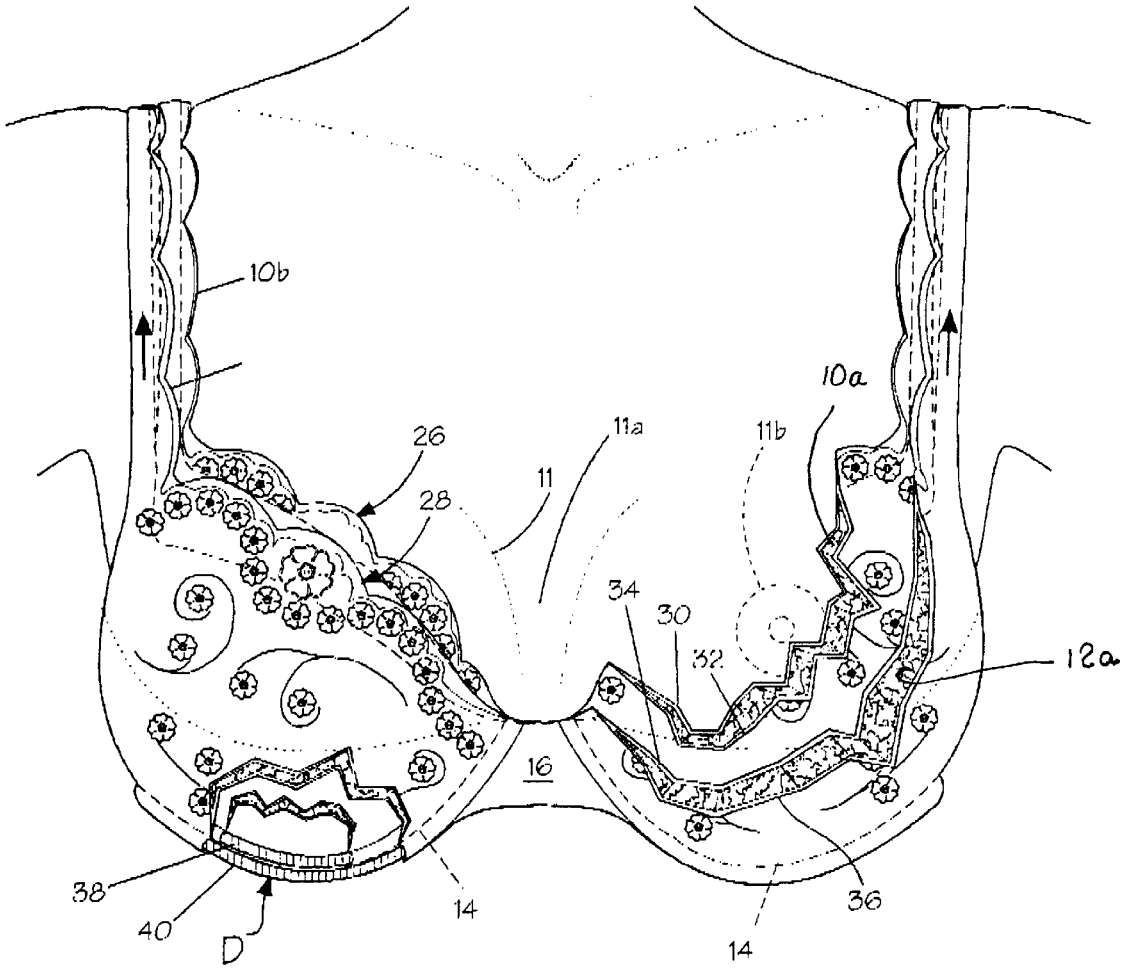
FIG. 2 is a front elevation of the brassiere of FIG. 1 with parts cut away and wherein the straps are adjusted to provide enhancement of breast cleavage and fullness.
Figure 3:
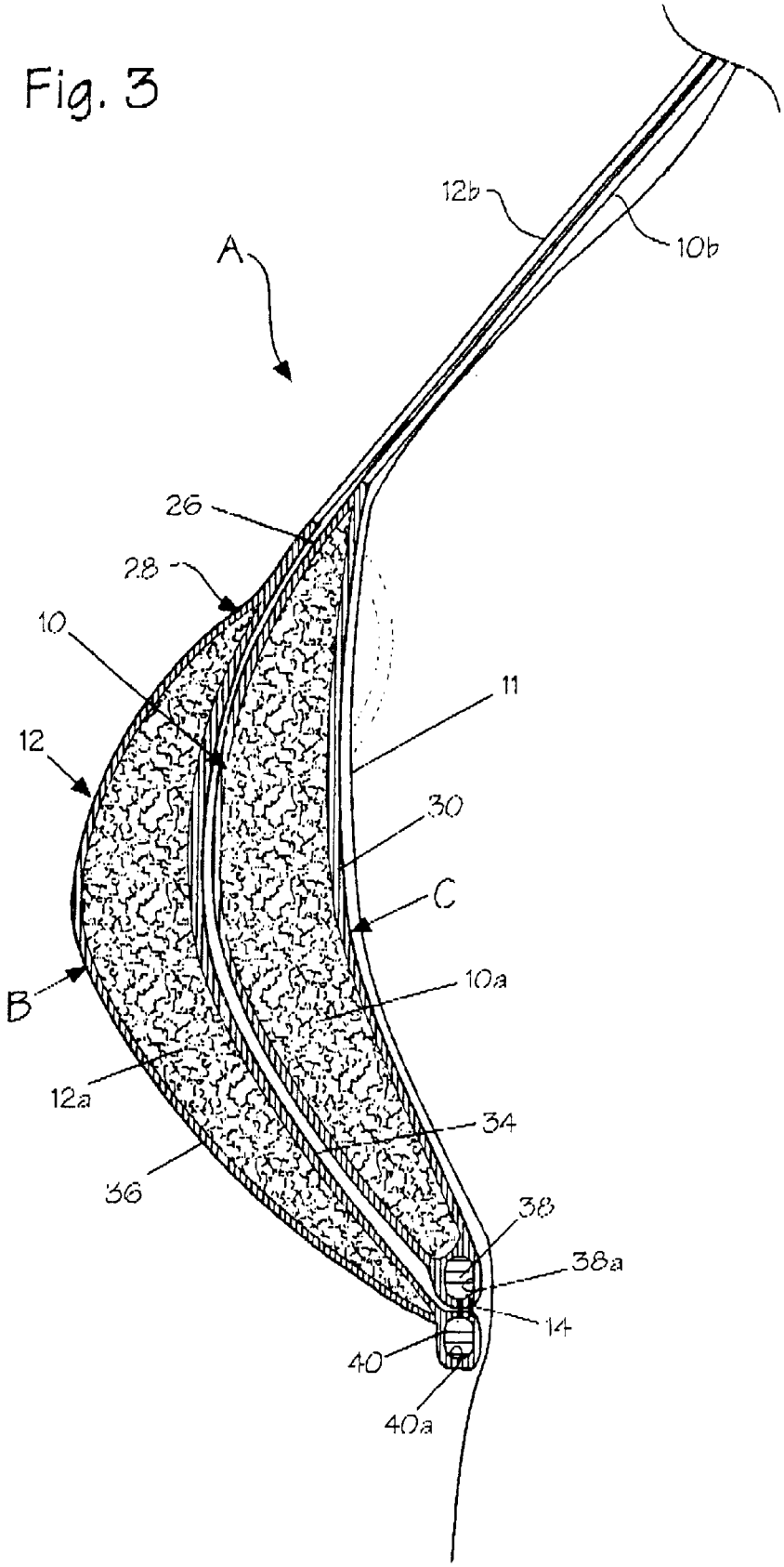
FIG. 3 is a sectional view taken along line 3—3 of FIG. 1.
Figure 3A:
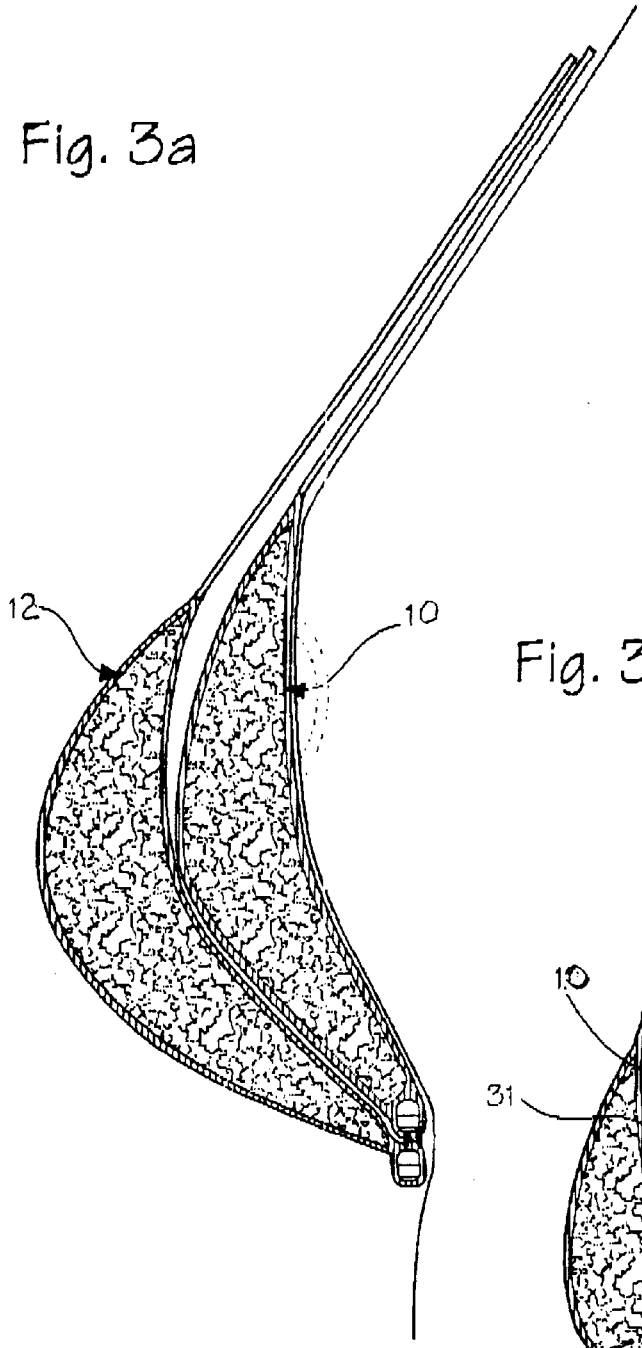
FIG. 3*a* is a sectional view similar to FIG. 3 wherein the lift of the outer cup is loosened for a more fuller appearance while the inner cup is maintained in a high lift adjustment to enhance breast cleavage and remain firmly against the breast.
Figure 3B:
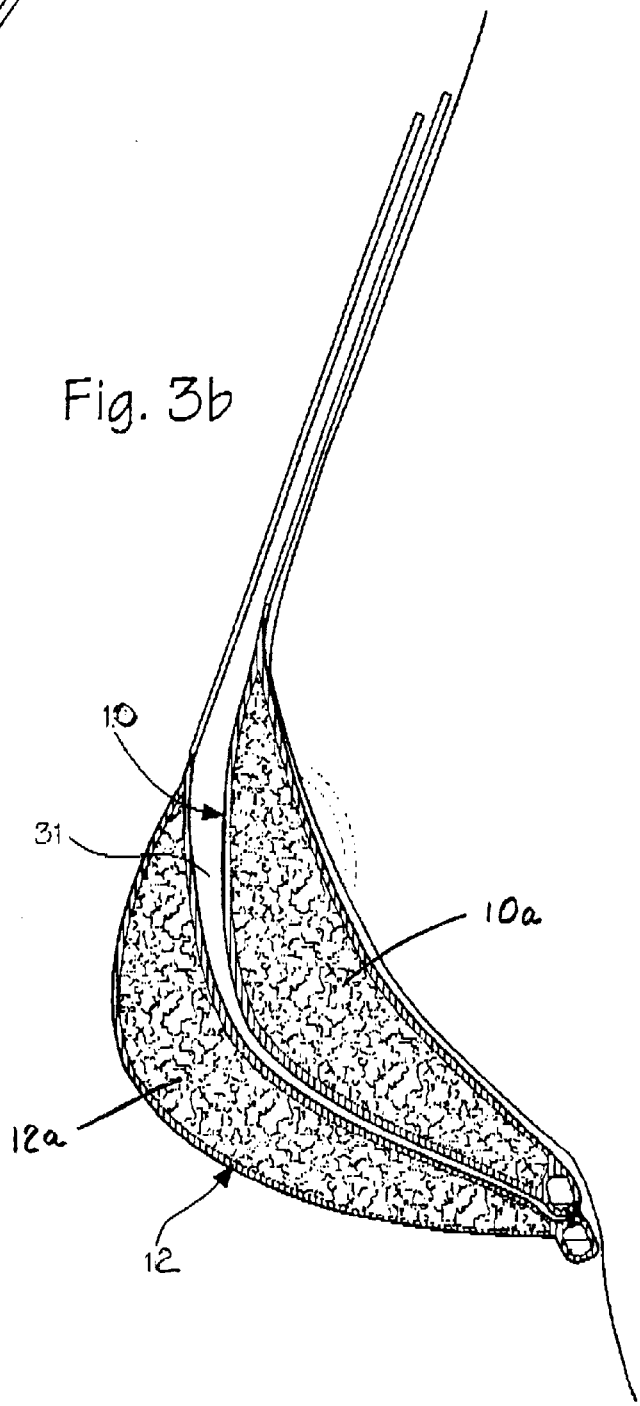
FIG. 3*b* is a sectional view of FIG. 3*a* wherein a woman is leaning forward slightly illustrating the firm attachment of the inner cup to the breast while the outer cup is allowed to move relative to the inner cup to maintain breast fullness and a natural appearance.
Figure 4:
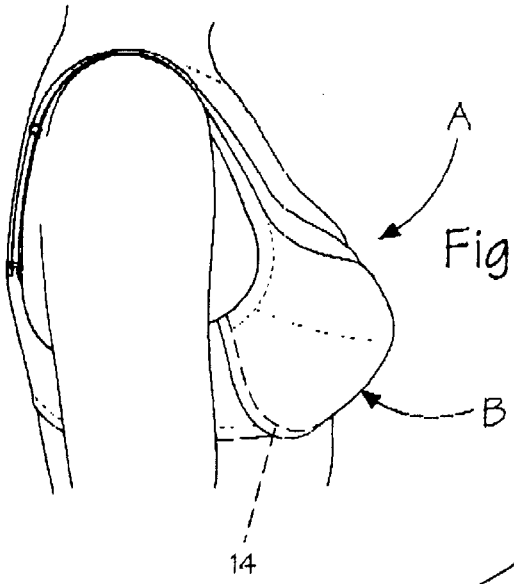
FIG. 4 is a side elevation illustrating a breast enhancement and support brassiere according to the invention.

As can best be seen in FIGS. 2 and 3–3*b,* each breast cup B, C, includes a self-contained inner cup, designated generally as 10; and a self-contained outer cup, designated generally as 12. Padding 10*a* is carried in inner cup 10, and padding 12*a* is carried in outer cup 12. Outer cup 12 substantially coextends with and covers inner cup 10. Attached edges, which are formed generally along a section denoted by dotted line 14, secure the inner and outer cups together along a lower edge 20 and side edges 22 of each breast cup (FIG. 1). The attachment terminates at center section 16, as can best be seen in FIG. 1. At least one shoulder strap is connected to each breast cup B, C, for adjusting the lift of the inner and outer cups. Preferably, a strap 10*b* is individually secured to inner cup 10 and a cup strap 12*b* is individually attached to outer cup 12, as will be more fully explained.

As can best be seen in FIG. 2, a curved reinforcing element, designated generally as D, is carried along lower edge 20 and side edges 22, 24 of each breast cup B, C, and generally coextends with the attached edges denoted by dotted lines 14. The reinforcing element extends substantially along the lower and side edges to impart lift to breast 11 when the shoulder straps are properly adjusted. The reinforcing element terminates at center section 16. It will be noted that while the lower and side edges of the inner cups are secured together, upper free edges, designated generally as 26 and 28 of the inner and outer cups, respectively, are free of attachments so that the inner and outer cups may freely move relative to each other during adjustments of shoulder straps 10*b* and 12*b,* and body movements, in use. In this manner, a wide variety of enhanced breast configurations may be provided. For example, the shoulder straps are adjusted in the directions of arrows 29 in FIG. 2, to provide more lift and enhance breast cleavage 11*a,* as compared to FIG. 1.

It will be noted that upper free edges 26 and 28 extend substantially from cup straps 10*b,* 12*b,* to center section 16. In this manner, inner cup 10 may be adjusted so that it is held firmly against the breast in a properly adjusted position of the straps so that the inner cup is maintained firmly against the breast regardless of body movement. Outer cup 12 may then be adjusted to provide a desired breast fullness appearance. As strap 12*b* is adjusted tighter, outer cup 12 is pulled up and tighter against inner cup 10 for a less full appearance. In addition, if highly resilient and compressible padding is used, the strap may be tightened until the padding is compressed a desired amount decreasing the appearance of fullness but increasing the lift and cleavage of the breast (FIG. 3). As strap 12*b* is loosened, the padding material may be allowed to decompress providing a fuller breast appearance (FIG. 3*a*). For this purpose, a highly resilience and compressible material, e.g. foam rubber, may be used for outer padding 12*a*. Even if the strap is adjusted loosely for full breast appearance, inner cup 10*a* is maintained firmly against the breast during body movements which normally would expose the small breast such as leaning forward (FIG. 3*a*). That is, if outer cup 12 is loosened and a space 31 is created between cups 10 and 12, cup 10 stays against the breast even if cup 12 moves relative to cup 10. It will be noted that the upper edges 26, 28 may be made of lace so that they may be made to interleaf and take on more of the appearance of a single bra.

As can best be seen in FIGS. 2 and 3, breast cups B and C each include a first and second fabric layer 30 and 32 attached around the periphery to form self-contained inner cup 10 and contain padding 10*a*. Each breast cup B, C, also includes a third fabric layer 34 and a fourth fabric layer 36 attached together about the periphery to form self-contained outer cup 12 and contain padding 12*a*. The various fabric layers comprising the inner and outer cups may be separate layers or may be layers folded upon themselves. In either case, reinforcing element D includes a first underwire 38 encased within the fabric layers of inner cup 10 in a channel 38*a,* and a second underwire 40 encased within the fabric layers of outer cup 12 in a channel 40*a*. Preferably, second underwire 40 is disposed substantially underneath first underwire 38. In this manner, when it is desired to provide increased lift on inner cup 10, tightening strap 12*b* of outer cup 12 imparts substantially all of the lifting force of second underwire 40 directly upwardly on first underwire 38 for increased lift. It is noted that inner and outer cups are secured together at stitching point 14 as can best be seen in FIG. 3.

Figure 5:
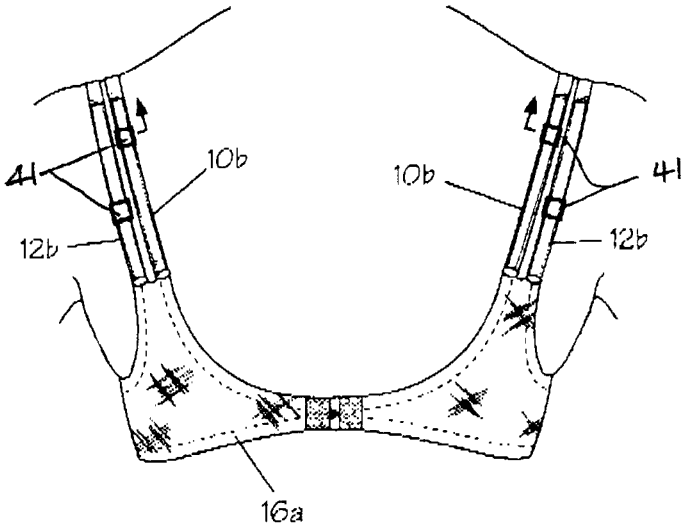
FIG. 5 is a rear elevation of a breast enhancement and support brassiere according to the invention illustrating an embodiment for separately adjustable inner and outer cups.

As can best be seen in FIG. 5, straps 10*b* and 12*b* include separate straps attached to back strap 16*a* of the brassiere in a conventional manner. Likewise, strap adjustments 41 are provided on each strap. Strap adjustments 41 may be conventional bras strap adjustment buckles. The use of an individual strap on each inner and outer cup provides for greater versatility in the independent adjustments of the breast cups. It also provides an advantage when the breast cup is worn by a large breasted woman in that additional support can be provided as well as enhanced breast appearance. In this case, less cleavage or fullness may be provided with increased support so that the natural appearance of lesser breasts may be had. It is also possible that other means of adjusting the inner and outer cups individually may be had beside separate straps or conventional strap adjustments. For example, a single strap may be attached to the back strap and overlay the shoulder which is then connected at individual points to the inner and outer cups by means of a Y strap, separate Velcro, or other suitable connections allowing individual adjustability of the inner and outer cups.

Figure 6:
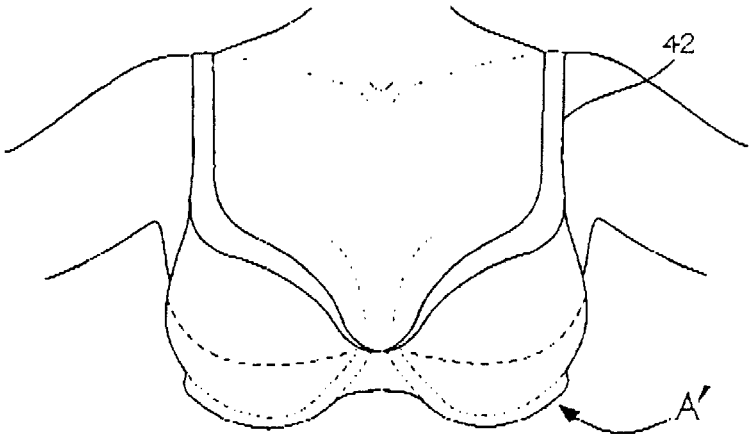
FIG. 6 is a front elevation illustrating another embodiment of a breast enhancement and support brassiere wherein only a single strap is utilized for each breast cup.

FIG. 6 illustrates an alternate shoulder strap arrangement where only a single adjustable shoulder strap 42 attached to each breast cup B and C in a brassiere A'. The remaining construction of brassiere A' is like that described for brassiere A. While not providing the full advantages of the invention, some advantages are retained such as maintaining inner cup 10 against the breast because of individual cup movement, particularly in small breasted women.

Thus, it can be seen that an advantageous construction can be had for a breast enhancement and support brassiere wherein small breasted women may assure themselves of complete concealment while enhancing the cleavage and fullness of their breasts. The inner cup is always maintained against the breast during body movements such as athletics and the like, or wearing low cut apparel, regardless of the adjustment of the outer cup for fullness and the like. The inner and outer cups are individual adjustment but always appear as a single cup on each breast. Double straps provide increased adjustability, but the straps may be concealed in a manner that only a single strap is noticed, or other measures may be taken, so that the brassiere has the appearance of a typical undergarment. In essence, the invention combines two brassieres in one wherein the inner brassiere is always firmly attached to the breast while providing increased cleavage and the outer cup may be adjusted to enhance cleavage and fullness while supporting the inner cup more or less, all while having the appearance of a conventional brassiere.

The use of two sets of breast cups with sets of wire in a "U" shape and two sets of straps provides added lift, size, and support. The two sets of cups and two sets of straps design allows women with hanging breasts to adjust their bra to desired firmness. This firmness is accomplished while maintaining a natural look. The two sets of straps give big breasted women added support. This support allows big breasted women to look shapelier in a natural way. The two sets of cups design allows women to wear low cut tops without compromising their natural look. The first set of cups is adjusted to the breast with the second set adjusted to them. This permits flexibility that makes the bra look natural.

While a preferred embodiment of the invention has been described using specific terms, such description is for illustrative purposes only, and it is to be understood that changes and variations may be made without departing from the spirit or scope of the following claims.

What is claimed is:

1. A breast enhancing brassiere comprising:

a) a pair of laterally spaced breast cups joined together by a center section on a front of said brassiere and a back strap on a back of said brassiere;

b) at least one shoulder strap connected to each breast cup;

c) each said breast cup including:

i. an inner cup and an outer cup;

ii. padding carried within said inner cup and outer cup;

iii. said outer cup substantially enclosing said inner cup;

iv. attached edges of said inner and outer cups being secured together along a lower edge and side edges of said breast cup;

v. a curved reinforcing element carried along said attached edges of said breast cup lifting said breast cups when said brassiere is worn and said shoulder straps are in a properly adjusted position; and vi. said inner cups and outer cups being generally separable along unattached upper free edges of said inner and outer cups so that said upper free edges may move relative to one another; and d) said inner cup being held firmly against the breast in said properly adjusted position of said straps regardless of movement of said outer cup to maintain breast coverage during body movements such as leaning forward when wearing low-cut apparel to provide a natural enhanced cleavage and breast appearance.

2. The device of claim 1 wherein said curved reinforcing element includes a first underwire associated with said inner cup, and a second underwire associated with said outer cup.

3. The device of claim 2 wherein said second underwire is disposed substantially below said first underwire so that said second underwire exerts a lifting force on said first underwire and inner cup.

4. The device of claim 1 wherein said inner cup and outer cup are substantially unattached along said upper free edges from adjacent said at least one shoulder strap to said center section of each breast cup.

5. The device of claim 1 wherein said at least one shoulder strap includes a cup strap attached to each of said inner and outer cups of each said breast cup, and each said cup strap including a strap adjustment so that the lift of said inner and outer cups may be adjusted individually.

6. The device of claim 5 wherein said inner and outer cups are generally unattached between said straps and said center section along said upper free edges so that relative movements between said cups may be had during adjustment of said cup straps.

7. The device of claim 5 wherein each said shoulder strap extends from said inner and outer cups to a back strap of said brassiere.

8. The device of claim 1 wherein said outer cup is a different cup size than said inner cup.

9. The device of claim 8 wherein said outer cup is a different chest size than said inner cup.

10. The device of claim 1 wherein said at least one shoulder strap includes means for individually adjusting the lift on said inner and outer cups of each said breast cup.

11. The device of claim 1 wherein each said breast cup includes a first layer and a second layer of fabric having attached edges to form said inner cup, said inner cup padding being contained within said first and second fabric layers; and each breast cup includes a third layer and a fourth layer of fabric having attached edges, said outer cup padding being contained between said third an fourth fabric layers.

12. The device of claim 11 wherein said curved reinforcing element includes a first underwire secured within said first and second fabric layers of said inner cup, and a second underwire secured within said third and fourth fabric layers of said outer cup, said second underwire being disposed substantially below said first underwire so that said second underwire exerts a lifting force on said first underwire and inner cup when said shoulder strap is properly adjusted.

13. A breast enhancing brassiere comprising:

a pair of laterally space breast cups joined together by a center section;

at least one shoulder strap connected to each breast cup;

each said breast cup including a self-contained inner cup for receiving the breast and a self-contained outer cup substantially enclosing said inner cup;

each said breast cup including a first layer and a second layer of fabric attached together to form said inner cup, and inner cup padding being contained within said first and second fabric layers;

each breast cup includes a third layer and a fourth layer of fabric attached together, and outer cup padding being contained between said third an fourth fabric layers;

said inner and outer cups being secured together at selected areas of a periphery of each said breast cup;

a reinforcing element carried along a lower and side edges of each said breast cup lifting said inner and outer cups when said brassiere is worn and said shoulder straps are in a properly adjusted position so that said inner cup is held firmly against the breast while said outer cup enhances breast fullness during body movement whereby breast enhancement and a nature appearance are maintained.

14. The device of claim 13 wherein said reinforcing element includes a first underwire associated with said inner cup, and a second underwire associated with said outer cup.

15. The device of claim 14 wherein said second underwire is disposed substantially below said first underwire so that said second underwire exerts a lifting force on said first underwire and inner cup.

16. The device of claim 13 wherein said upper edges of said inner and outer cups are substantially unattached during use along a section generally from said at least one shoulder strap to said center section of each breast cup so that individual free movements of said upper edges may be had.

17. The device of claim 16 including a shoulder strap attached to each of said inner and outer cups of each said breast cup, and each said strap including a strap adjustment so that the lift of said inner and outer cups may be adjusted separately.

18. The device of claim 13 wherein said outer cup has a different size cup than said inner cup to substantially receive said inner cup.

19. A breast enhancing brassiere comprising:

a pair of laterally spaced breast cups joined together by a center section;

at least one shoulder strap connected to each breast cup;

inner cups for receiving the breasts included in said breast cups having an integral layer of padding;

outer cups carried adjacent said inner cups having an integral layer of padding;

a curved reinforcing element carried along lower and edges of said breast cup lifting said inner and outer cups when said brassiere is worn and said shoulder straps are in a properly adjusted position;

means securing said inner and outer cups together at selected areas; and upper free edges of said inner and outer edges being unattached to permit relative movements of said free edges during adjustment of said shoulder straps so that said inner cups remain firmly against the breast to enhance breast cleavage appearance while said outer cups provide a fuller breast appearance.

20. The device of claim 19 wherein said reinforcing element includes a first underwire associated with said inner cup, a second underwire associated with said outer cup, and said second underwire being disposed adjacent said first underwire to support a lifting of said inner cup.

21. The device of claim 19 wherein said inner cup and outer cup are substantially unattached along said upper free edges in use along a section generally from said shoulder straps to said center section of each breast cup.

22. The device of claim 19 including a shoulder strap arrangement having a strap adjustment so that the lift imparted by said inner and outer cups may be adjusted individually.

23. The device of claim 19 wherein said upper free edge of said inner and outer cups are constructed and arranged near each other to give the appearance of a single breast cup.

24. The device of claim 23 wherein said shoulder straps include a means for individually adjusting the lift on said inner and outer cups of each said breast cup with said upper free edges being free from cup adjustment while still appearing as a single cup in use.

* * * * *